US007555815B2

(12) United States Patent
Tate, Jr. et al.

(10) Patent No.: US 7,555,815 B2
(45) Date of Patent: Jul. 7, 2009

(54) DOOR HINGE ARRANGEMENT

(75) Inventors: Ralph Tate, Jr., Evansville, IN (US); Joseph L. Coleman, Evansville, IN (US); Mural E. West, Evansville, IN (US); Randy Howell, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 177 days.

(21) Appl. No.: 11/130,720

(22) Filed: May 17, 2005

(65) Prior Publication Data

US 2006/0260097 A1 Nov. 23, 2006

(51) Int. Cl.

| | |
|---|---|
| ***E05F 1/02*** | (2006.01) |
| ***E05D 7/00*** | (2006.01) |
| ***E05D 15/00*** | (2006.01) |
| ***A47B 96/04*** | (2006.01) |

(52) U.S. Cl. ..... 16/309; 16/221; 16/312; 49/381; 312/405

(58) Field of Classification Search ..... 16/221, 16/309, 312–317, 319, 343, 348, 357, 235, 16/236, DIG. 43; 49/381, 385, 327, 501; 312/405, 326, 329, 138.1

See application file for complete search history.

(56) References Cited

U.S. PATENT DOCUMENTS

| | | | | | |
|---|---|---|---|---|---|
| 2,867,839 | A * | 1/1959 | Squire | 16/358 |
| 2,955,315 | A * | 10/1960 | Squire et al. | 16/375 |
| 2,975,013 | A * | 3/1961 | Wallace et al. | 312/296 |
| 3,398,487 | A * | 8/1968 | Matyas | 49/239 |
| 3,546,736 | A * | 12/1970 | Booth | 16/312 |
| 3,628,845 | A * | 12/1971 | Grimm | 312/309 |
| 3,916,481 | A * | 11/1975 | Pittasch | 16/245 |
| 4,090,274 | A * | 5/1978 | Bourgeois | 16/317 |
| 4,774,740 | A * | 10/1988 | Gidseg et al. | 16/344 |
| 5,369,842 | A * | 12/1994 | Beatty | 16/317 |
| 5,500,984 | A * | 3/1996 | Lee | 16/309 |
| 7,111,363 | B2 * | 9/2006 | Lee et al. | 16/376 |

FOREIGN PATENT DOCUMENTS

| | | | |
|---|---|---|---|
| CN | JP 01275877 A | * | 11/1989 |
| FR | 2575512 A1 | * | 7/1986 |

* cited by examiner

*Primary Examiner*—Victor Batson
*Assistant Examiner*—David C Reese
(74) *Attorney, Agent, or Firm*—Kirk Goodwin; Michael D. Lafrenz

(57) ABSTRACT

A door hinge arrangement for a door is provided including a hinge bearing and a hinge pin adapted to be received in the hinge bearing and being rotatable in the hinge bearing about a vertical axis of the hinge pin. The hinge pin has a protruding cam portion extending perpendicular to the axis and the hinge bearing has a recess formed in a side wall to receive a length of the cam portion when the hinge pin is in a first angular orientation relative to the hinge bearing corresponding to a closed position. When the hinge pin is rotated relative to the hinge bearing to a second angular orientation, the cam acts against the recess to translate the axis of the pin from a first axial position to a second axial position, such that the hinge pin will first be translated laterally as the hinge pin is rotated, and then the hinge pin will be rotated about the second axial position.

19 Claims, 9 Drawing Sheets

DOOR HINGE ARRANGEMENT

BACKGROUND OF THE INVENTION

Door hinge constructions are well known and generally include a hinge pin defining an axis of rotation for the door and a hinge bearing for receiving the hinge pin. Generally the axis of rotation of the door remain in a fixed position during the entire opening and closing operation.

In some environments, pivotable doors are arranged adjacent to one another, and open and close towards one another. This can lead to an undesired engagement between the edges of the two doors as one pivots relative to the other, particularly where the positioning of the two doors is close. In some particular environments, such as in French door style refrigerators or some side-by-side refrigerators, there are additional components on the doors, such as sealing gaskets, which can also detrimentally engage one another during the opening and closing operations, causing additional friction and also causing the parts to close improperly. For example, in a French door refrigerator, such as disclosed in U.S. Pat. Nos. 3,248,159, 4,288,135 and 5,975,661, adjacent doors are provide with sealing gaskets which may include internal magnets which are to sealingly engage one another when the doors close. On occasion, the adjoining gaskets, due to the pivotal movement therebetween, when one door closes relative to the other, interfere with one another and do not effect a tight seal therebetween. This could result in the gaskets not seating against one another in a flush sealing arrangement, thereby preventing a tight seal which can lead to extra energy being consumed by the appliance trying to compensate for the improper seal, damage to goods located in the refrigeration appliance if the compensation is inadequate, and condensation or other unsightly and perhaps damaging conditions to occur. In a side-by-side style refrigerator, a similar result could occur where a gasket might remain engaged against an adjacent gasket or door preventing that gasket from properly sealing against a face of the appliance.

Therefore, it would be an improvement in the art if there were provided a hinge arrangement that would overcome the above noted problems.

SUMMARY OF THE INVENTION

The present invention provides a hinge arrangement for a door that addresses the problems noted above, and specifically prevents adjacent doors and components associated with the doors from coming into pivotal engagement with each other when the doors are pivoted into closed positions towards each other.

A door hinge arrangement for a door is provided including a hinge bearing and a hinge pin adapted to be received in the hinge bearing and being rotatable in the hinge bearing about a vertical axis of the hinge pin. The hinge pin has a protruding cam portion extending perpendicular to the axis and the hinge bearing has a recess formed in a side wall to receive a length of the cam portion when the hinge pin is in a first angular orientation relative to the hinge bearing corresponding to a closed position. When the hinge pin is rotated relative to the hinge bearing to a second angular orientation, the cam acts against the recess to translate the axis of the pin from a first axial position to a second axial position, such that the hinge pin will first be translated laterally as the hinge pin is rotated, and then the hinge pin will be rotated about the second axial position.

In an embodiment, the hinge pin and the hinge bearing have mating helical surfaces such that as the hinge pin rotates relative to the hinge bearing, the hinge pin is caused to move axially relative to the hinge bearing.

In an embodiment, the hinge pin and the hinge bearing have a detent mechanism provided therebetween such that the hinge pin, in certain angular orientations relative to the hinge bearing, will be prevented from rotating further, or will be releasably held in a position, requiring an additional level of force to rotate the hinge pin out of that position.

DETAILED DESCRIPTION OF THE PREFERRED EMBODIMENT

The present invention relates to a door hinge arrangement which can be used in a wide variety of applications, generally wherever there is a door that can be pivoted to an open position and which can accommodate some lateral sliding of the door. In order to provide an environment for describing the invention, the hinge arrangement is discussed in terms of being used on a French door style refrigeration appliance, although the invention should not be deemed to be limited to use in such an environment. Other uses and environments, such as on other types of appliances, cabinets and locations having face mounted doors, including side-by-side refrigeration appliances.

Figure 1:
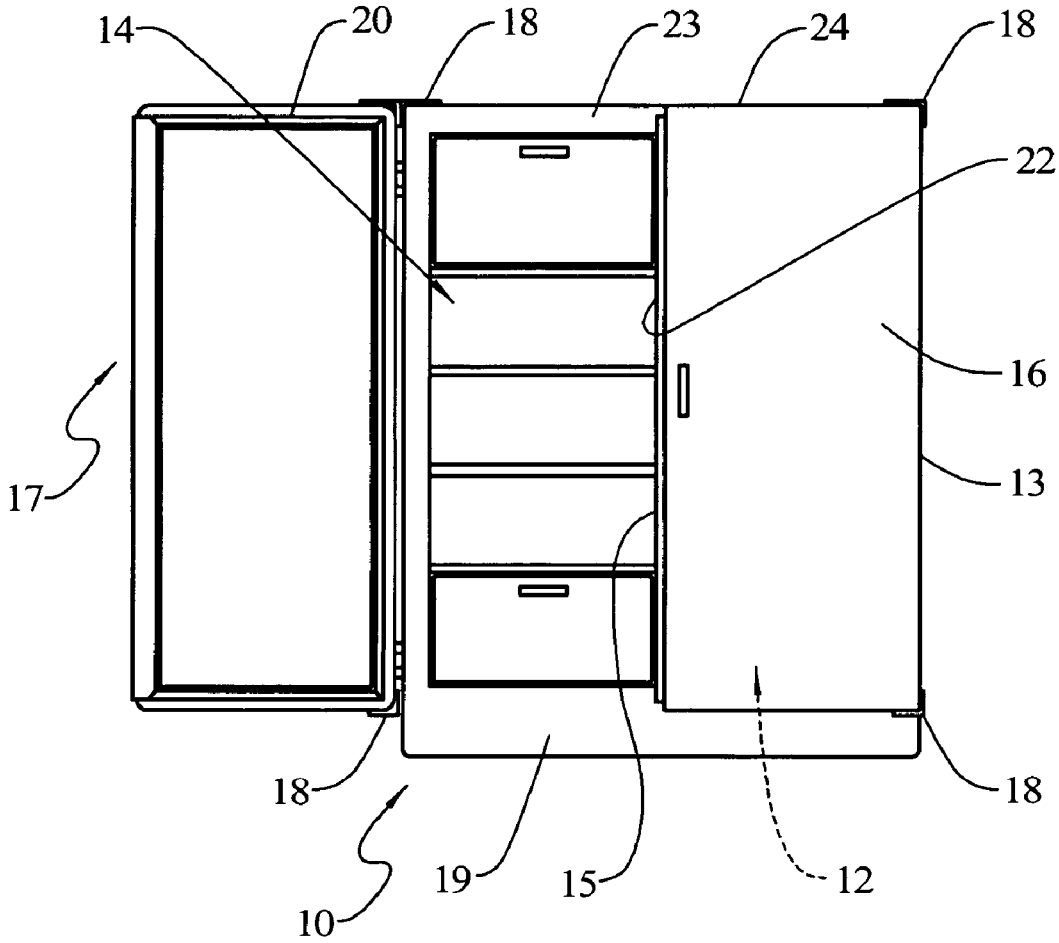
FIG. 1 is a front perspective view of a refrigeration device with a door hinge arrangement embodying the present invention.

In FIG. 1, there is seen a refrigerator 10, commonly referred to as a French door style refrigerator, with a single refrigeration compartment 12 located within a single cabinet 13 and accessible through either one of two openable doors 16 and 17. Conventionally, the interior of the refrigerator 10 is cooled by an evaporator (not shown) located in the freezer compartment and a compressor and a condenser (not shown) located in a machinery compartment 19. The doors 16, 17 are carried on hinges 18, shown in greater detail in FIGS. 2-10, to permit them to pivotally move into an open position as shown.

Figure 2:
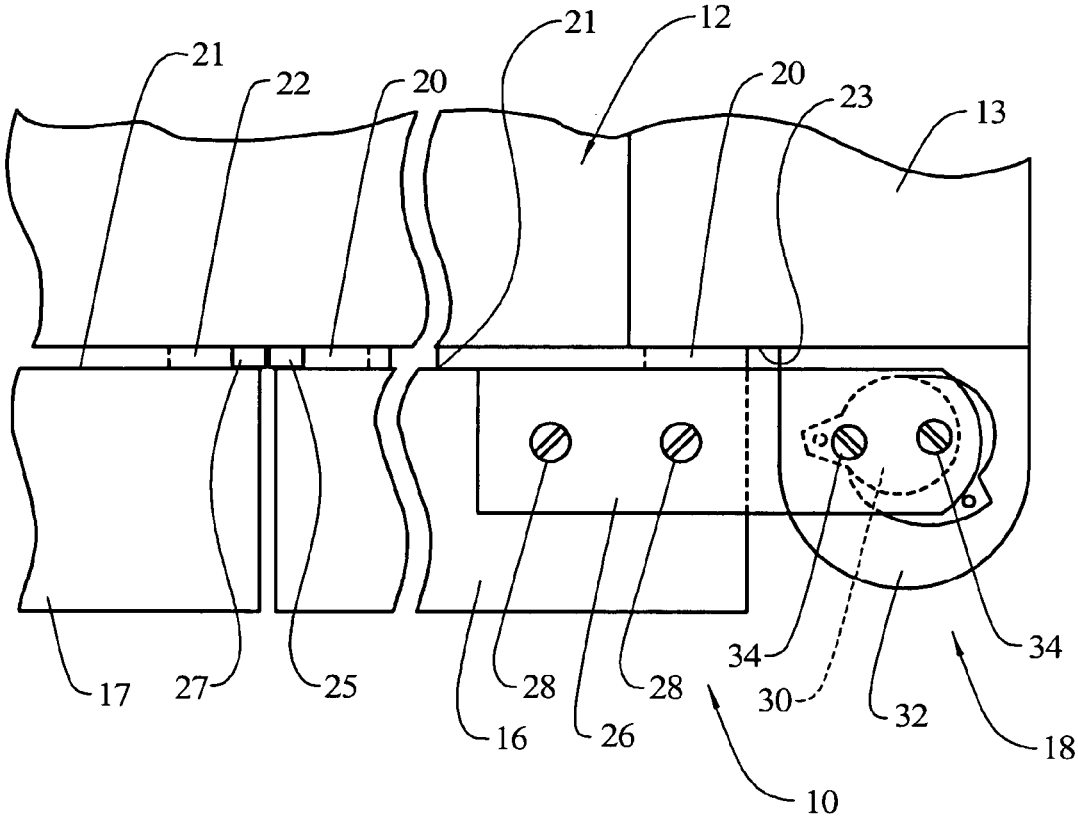
FIG. 2 is a partial plan view of the refrigeration device of FIG. 1 and one hinge assembly.
Figure 2A:
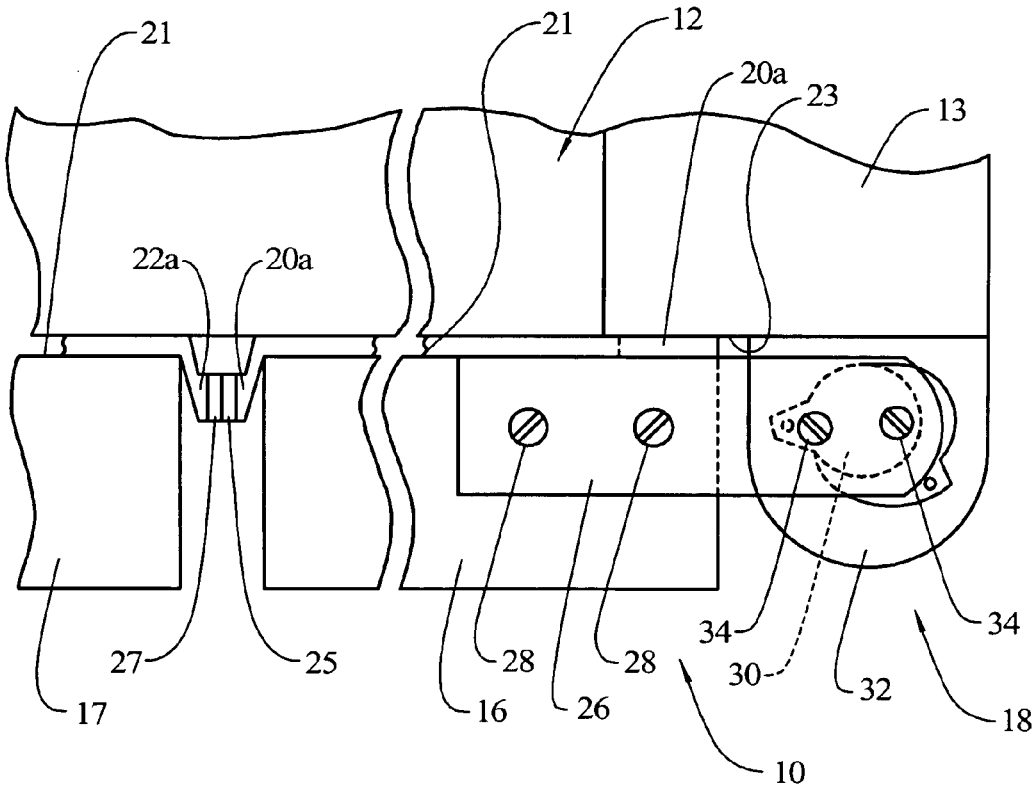
FIG. 2*a* is a partial plan view of the refrigeration device of FIG. 1 and one hinge assembly with an alternative placement of the gaskets between the doors.

Typically a rubber or plastic gasket 20, 22 (FIGS. 1, 2 and 2*a*) surrounds an inside face 21 of each door 16, 17, respectively, to provide an airtight seal between the inside face of each door and a corresponding front surface 23 of the refrigerator cabinet 24 surrounding the openings forming the refrigeration compartments 12, 14. Alternatively, as shown in FIG. 21, a rubber or plastic gasket 20*a*, 22*a*, may be provided between facing edges of doors 16, 17 to provide a seal between the doors. Except at the area along the free edge of the doors, the gaskets 20,22 are held in a tight sealed condition against the front surface 23 of the refrigerator cabinet 13 by magnets carried within the flexible and resilient gaskets which are attracted to the steel construction of the refrigerator cabinet. As shown in FIGS. 2 and 2*a*, in a French door style refrigerator, the seal between the two doors, at their free edges, is provided by the adjacent gaskets 20, 22 or 20*a*, 22*a* with each other. In some arrangements this is provided by having internal magnets 25, 27 within the opposing gaskets 20, 22, 20*a*, 22*a* which attract each other and provide a tight seal between the opposing gaskets.

A drawback of this arrangement is that when the doors are pivoted relative to one another to open or close, the two opposing gaskets 20, 22, 20*a*, 22*a* rub against one another and may not always provide a tight and complete seal.

To overcome this problem, the present invention provides a hinge construction that shifts or translates the compartment doors 16, 17 laterally outwardly as the doors are first opened, and shifts or translates each door laterally inwardly toward the other door as the closing operation completes. In this manner, the final motion of the doors, and hence gaskets, is laterally towards each other, rather than a pivotal movement. The lateral moving apart also helps break the magnetically effected seal between the gaskets since the force of magnetic attraction is reduces as the gaskets are translated away from one another.

FIG. 2 illustrates a plan view of the hinge area for the refrigeration compartment door 16. A hinge bracket 26 is secured to the door 16, such as by screws 28, or other known fastening methods, and extends laterally outwardly of the door to lie over a hinge pin 30 and a hinge bearing 32. The hinge bracket 26 is secured to the hinge pin 30, again, such as by screws 34 or other known fastening methods so that the hinge pin is stationary relative to the door 16.

Figure 3:
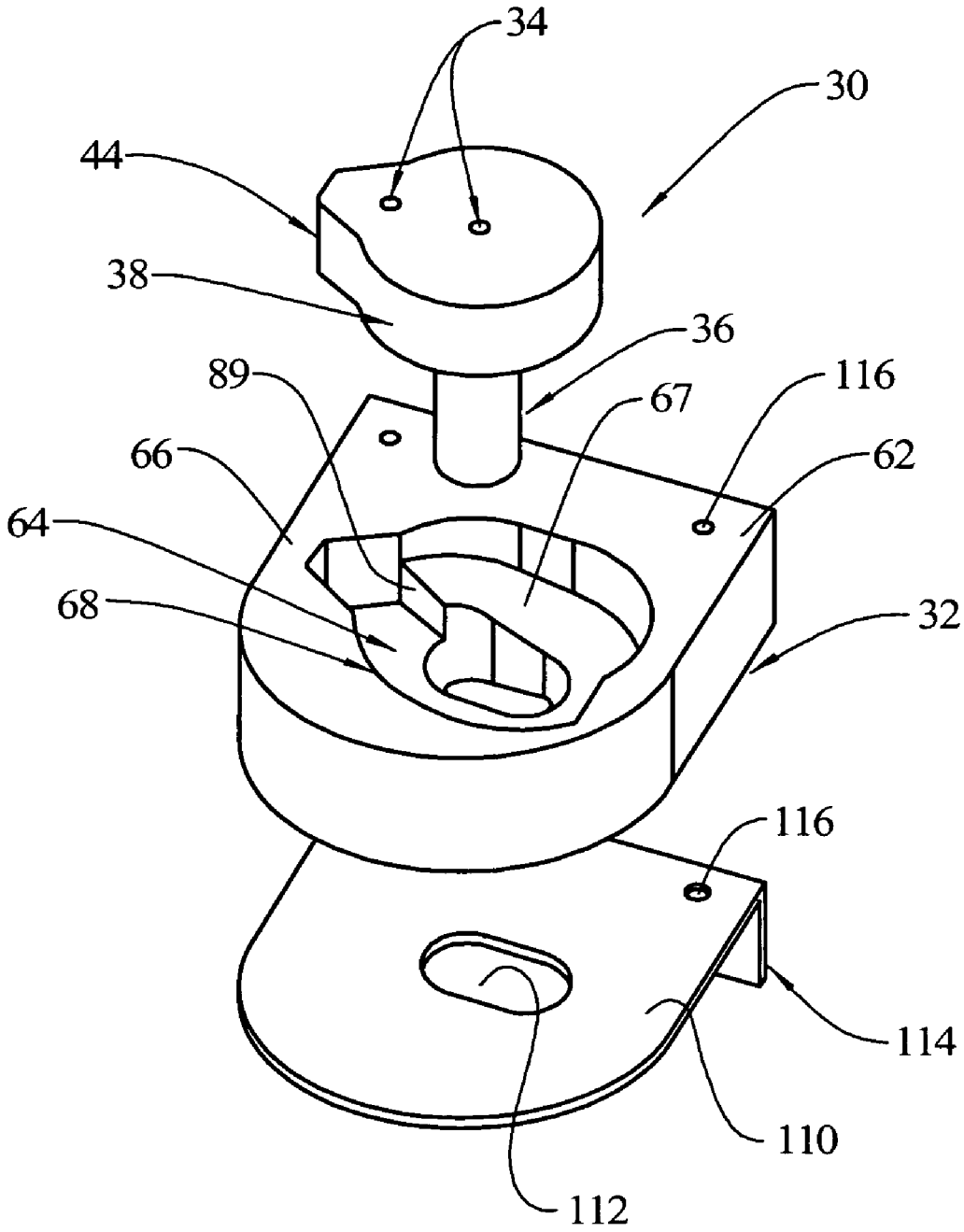
FIG. 3 is a perspective exploded view of the hinge assembly of FIG. 2.
Figure 4:
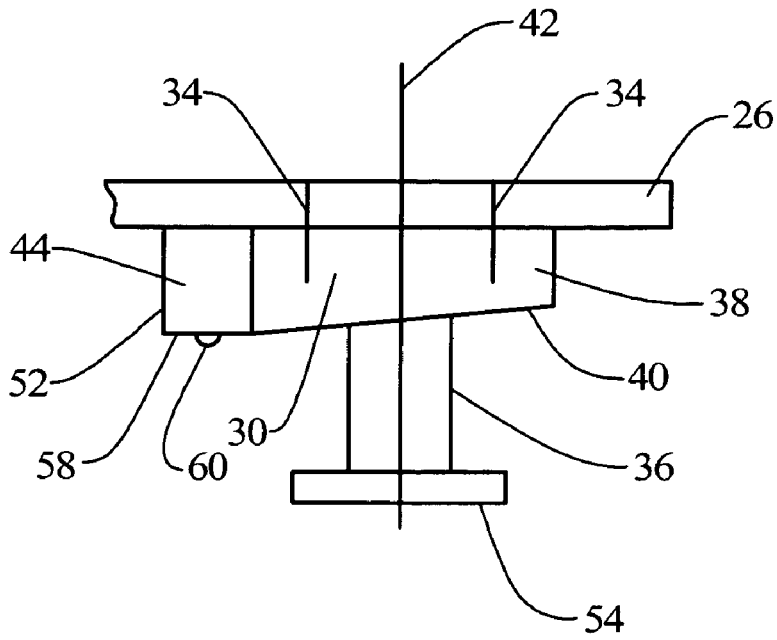
FIG. 4 is an isolated side elevational view of the door hinge pin and attachment bracket.
Figure 7:
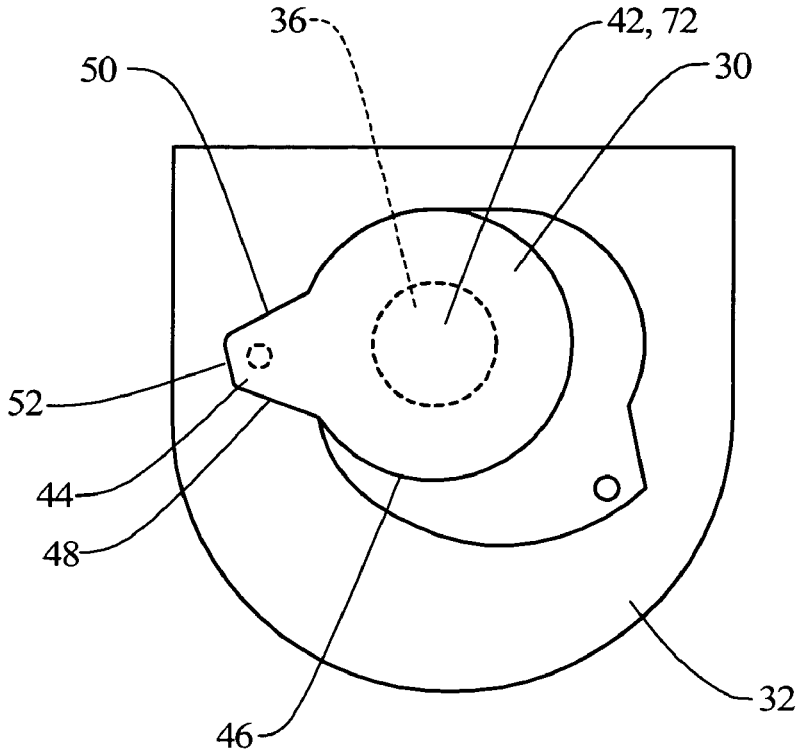
FIG. 7 is a plan view of a door hinge pin and a door hinge bearing embodying the present invention in a closed position of the door.

The hinge pin 30 can be viewed in perspective in FIG. 3, in profile in FIG. 4 and in plan view in FIG. 7. The hinge pin 30 has a generally cylindrical shaped rod portion 36 at a lower end and an enlarged and generally cylindrical shaped head portion 38 at an upper end. An underside of the head portion 38 is an annular support surface 40. An axis of rotation 42 extends vertically through a centerline of the rod portion 36 and the head portion 38. A laterally projecting cam portion 44 extends generally perpendicularly from the axis 42 outwardly from a cylindrical side wall 46 of the head portion 38. The cam portion 44 has a pair of sidewalls 48, 50 angled inwardly toward a distal end 52 of the cam portion which is rounded. A retaining cap or washer 54 can be secured to a bottom end 56 of the hinge pin 30 by means of a separate threaded fastener or by means of a threaded connection between the cap and the rod portion 36, or by other well known fastening arrangements after the hinge pin is assembled to the hinge bearing 32 as described below. A hemispherical projection 60 may extend downwardly from an underside 58 of the cam portion 44, whose function is described below.

Figure 5:
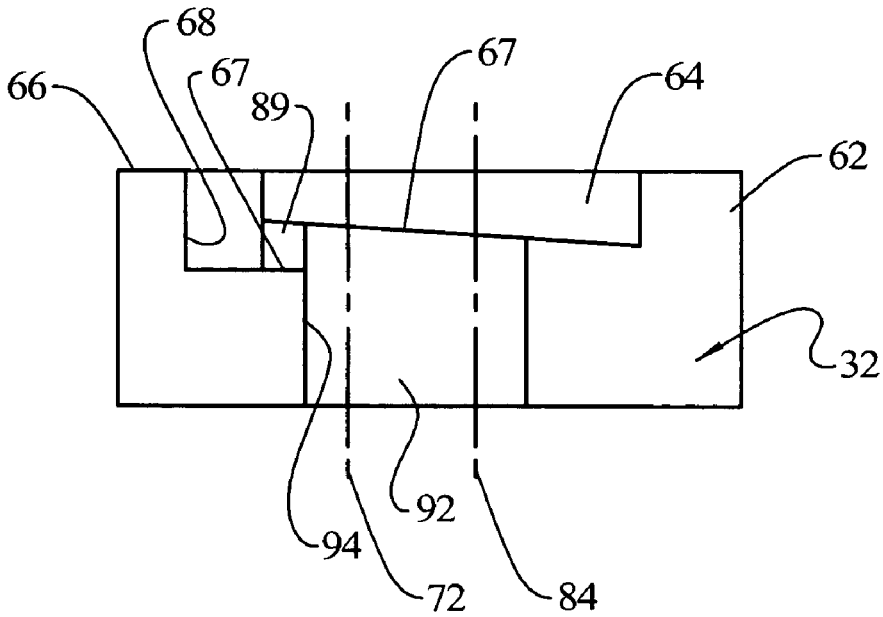
FIG. 5 is an isolated side sectional view of the door hinge bearing.
Figure 6:
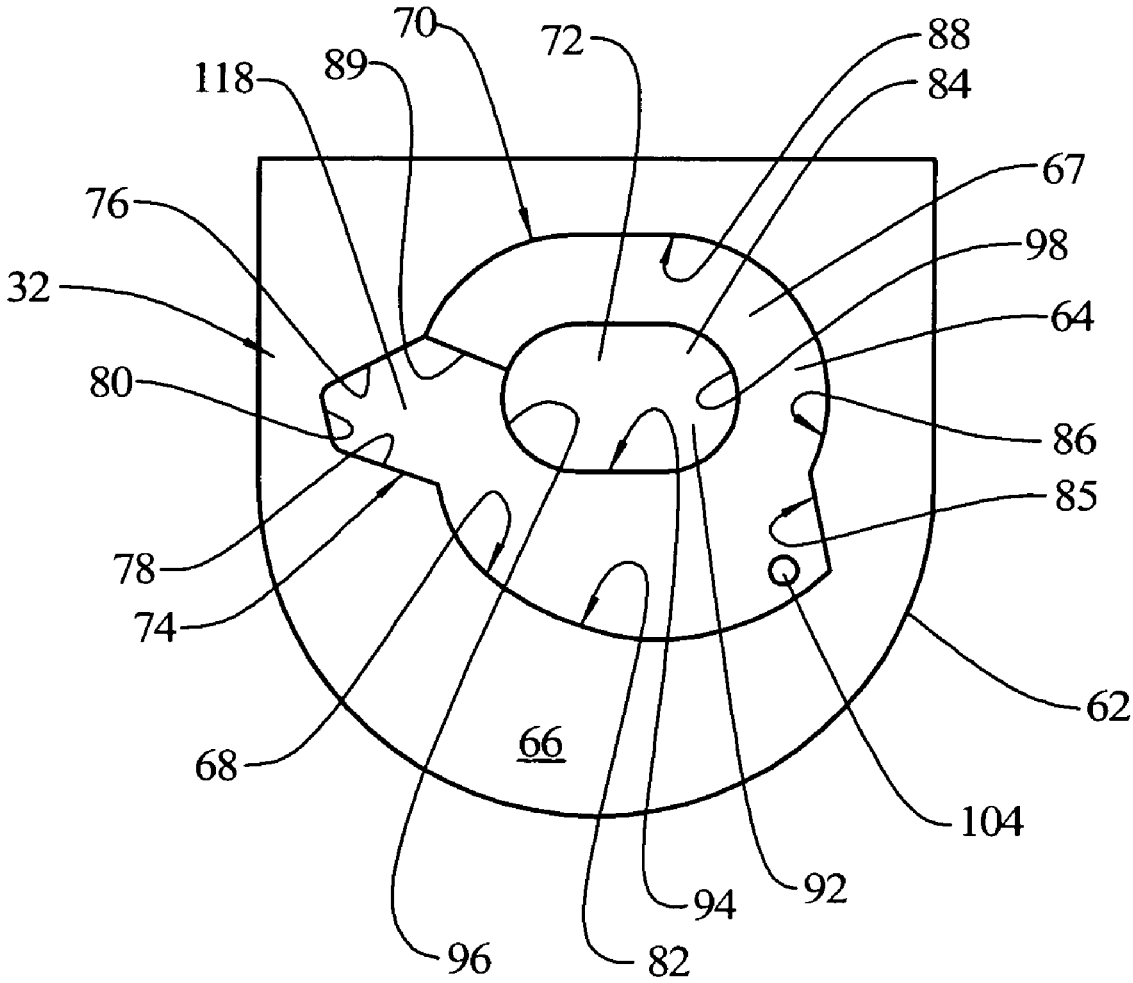
FIG. 6 is a plan view of the door hinge bearing in isolation.

The hinge bearing 32 is shown in perspective in FIG. 3, in a side sectional detail in FIG. 5 and in an isolated plan view in FIG. 6. The hinge bearing 32 has a body 62 with a pocket 64 forming a depression in a top wall 66 of the body. A depth of the pocket 64 is substantially the same as a height of the head portion 38 of the hinge pin 30 and is defined by a bottom support wall 67. The pocket 64 is defined by a substantially vertical sidewall 68 with a varying contour as seen in FIG. 6.

A first section 70 of the sidewall 68 is a partial circular cylinder with a center point 72 in a first axial position. A radius of the first section 70 is substantially the same, or slightly greater than a radius of the cylindrical head portion 38 of the hinge pin 30. A second section 74 of the sidewall 68 is shaped complementary to the cam portion 44 of the hinge pin 30 and has a wall portion 76 and a wall portion 78 angled inwardly in a direction away from the center point 72 with a rounded bight 80. A third section 82 of the sidewall 68 is a partial circular cylinder with a center point 84 in a second axial position. A radius of the third section 82 is substantially the same, or slightly greater than a distance from the axis 42 of the hinge pin 30 to the distal end 52 of the cam portion 44. A fourth section 85 of the sidewall 68 is a flat wall corresponding in length to a length of the sidewall 48 of the cam portion 44. A fifth section 86 of the sidewall 68 is a partial circular cylinder having the same center point 84 as the third section 82. A radius of the fifth section 86 is the same, or slightly greater than the radius of the cylindrical head portion 38 of the hinge pin 30. A sixth section 88 of the sidewall 68 is a straight section arranged tangentially to the first and fifth sections.

In an embodiment, as shown, the support wall 67 may be sloped in the form of a helix with a lowest point adjacent the second section 74 of the sidewall 68 and sloping upwardly in a counter clockwise direction with a highest point adjacent the first section 70 where a vertical step 89 connects the lowest and highest points. In such an embodiment, the support surface 40 of the hinge pin 30 is also formed with a complementary helical slope.

Within the pocket 64, and extending through to a bottom surface 90 of the body 62 is an oval shaped opening 92. The opening 92 is formed by a sidewall 94 having a first section 96 being a semicylinder having its center point coextensive with the center point 72 of the first section 70 of the sidewall 68. A radius of the first section 96 is substantially the same, or slightly greater than a radius of the cylindrical rod portion 36 of the hinge pin 30. The sidewall 94 has a second section 98 which is a semicylinder having its center point coextensive with the center point 84 of the third 82 and fifth 86 sections of the sidewall 68. A radius of the second section 98 is substantially the same, or slightly greater than the radius of the cylindrical rod portion 36 of the hinge pin 30. A third section 100 and a fourth section 102 of the sidewall 94 are straight sections arranged tangentially to the first 96 and second 98 sections and opposite one another. A hemispherical depression 104 may be provided in the support wall 67 adjacent to a junction between the third 82 and fourth 85 sections of the sidewall 68.

As shown in FIG. 2, in some embodiments, a support bracket 110 may be provided to mount to the front face 23 of the refrigeration appliance 10 to support the hinge bearing 32. In other embodiments, the hinge bearing 32 may be secured directly to the refrigeration cabinet. The support bracket 110 has generally the same outer contour as the hinge bearing 32 and also has a central opening 112 shaped complementary to and aligned with the opening 92 in the hinge bearing. A downwardly extending wall 114 along a back edge of the support bracket 110 may be secured to the refrigeration appliance 10, such as by screws or other types of fasteners. Guide holes 116 may be provided on the hinge bearing 32 and the support bracket 110 to receive screws or other fasteners to hold the hinge bearing on the support bracket.

In operation, and with respect to the hinges for the refrigeration compartment door 16 of FIG. 1, a hinge assembly comprising the hinge pin 30 and the hinge bearing 32 are assembled together with the rod portion 36 of the hinge pin extending into the opening 92 in the hinge bearing such that the support surface 40 of the hinge pin rests on the support wall 67 of the hinge bearing. The cam portion 44 of the hinge pin 30 is received in a recess 118 defined by the second section 74 of the side wall 68 and the axis 42 of the hinge pin is aligned with the center point 72 and axis of the hinge bearing. In this position, the refrigeration compartment door 16 is in the closed position as seen in FIG. 2. This position of the hinge pin 30 and the hinge bearing 32 is shown in FIG. 7.

As mentioned above, the retaining cap or washer 54 may be provided to be secured to a lower end of the rod portion 36 of the hinge pin 30. This cap 54 could be provided after the hinge pin 30 is engaged into the hinge bearing 32 to prevent an unwanted vertical disengagement of the hinge pin from the hinge bearing. Although gravity would normally hold the hinge pin 30 in the hinge bearing 32, the cap 54 assures that a manual force applied to the door 16, which might have a vertical upward component, would not dislodge the hinge pin from the hinge bearing.

Figure 8:
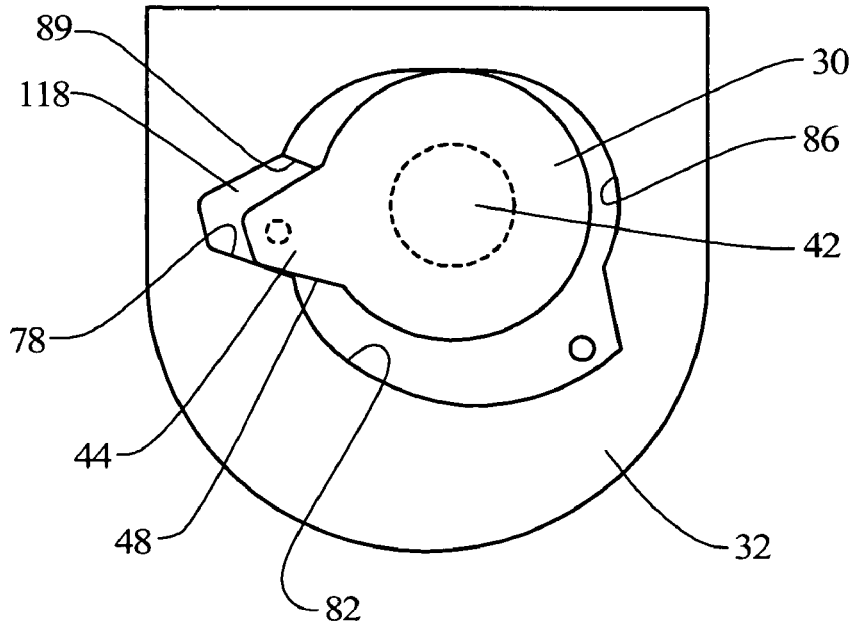
FIG. 8 is a plan view of the two door hinge members of FIG. 1 in a very slightly opened position.

As the refrigeration compartment door 16 is initially opened, the door is caused to pivot around the axis 42 of the hinge pin 30, due to the connection of the door to the hinge pin through the bracket 16. At this point, the axis 42 is aligned with the center point and first axial position 72 of the hinge bearing 32. However, as soon as the pivoting rotation begins, the cam portion 44, and specifically the sidewall 48, bears against the wall portion 78 of the hinge bearing 32, and due to their angled orientations relative to a radial line from the axis 42, the hinge pin 30 is translated to the right, as seen in FIG. 7, to move to a position as shown in FIG. 8. This translation is accommodated by the slot shape of the opening 92 which receives the rod portion 36 of the hinge pin 30. During this time, the first compartment door 16 is also translated to the right, away from the second compartment door 17, thus pulling the gasket 20 away from the gasket 22, without interference, and allowing the magnetic attraction to reduce.

Figure 9:
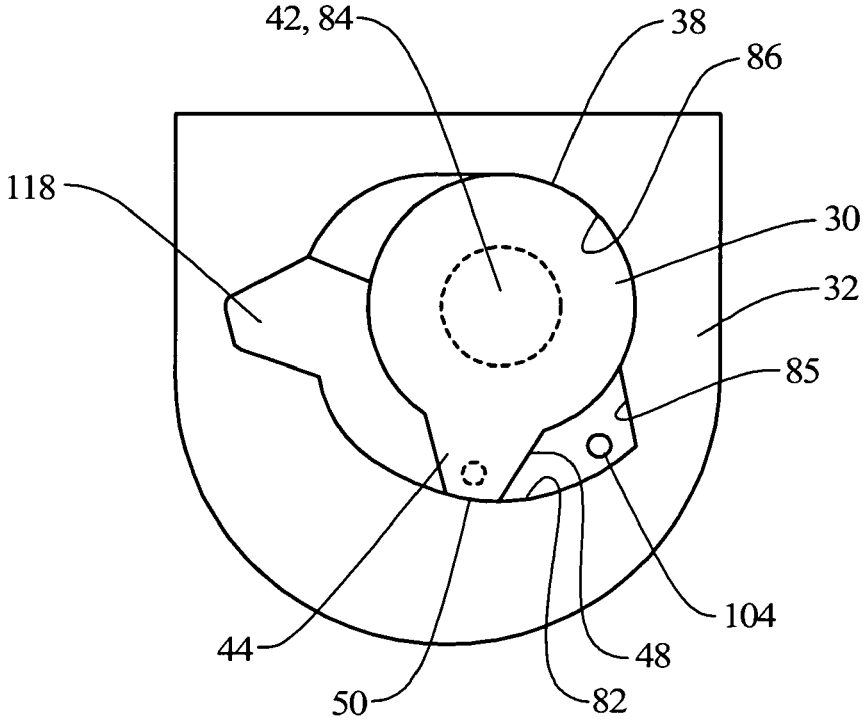
FIG. 9 is a plan view of the two door hinge members of FIG. 1 in a position more open than in FIG. 8.

As the opening of the door 16 continues, the hinge pin 30 is translated further to the right until the axis 42 of the hinge pin is aligned with the center point and second axial position 84 of the hinge bearing 32. The rotation of the hinge pin 30 relative to the hinge bearing continues, with the cylindrical contour of the head portion 38 of the hinge pin 30 being rotationally supported and guided by the circular fifth section 86 of the sidewall 68, and the rounded end 52 of the cam portion 44 being rotationally supported and guided by the circular third section 82 of the sidewall 68, as seen in FIG. 9. This rotational movement will continue until the door is pivoted to its full open position. When that occurs, for example after about 120 degrees of opening movement in one embodiment, the sidewall 48 of the cam portion 44 will abut the fourth section 85 of the sidewall 68 to prevent further opening movement of the door, as shown in FIG. 10.

Figure 10:
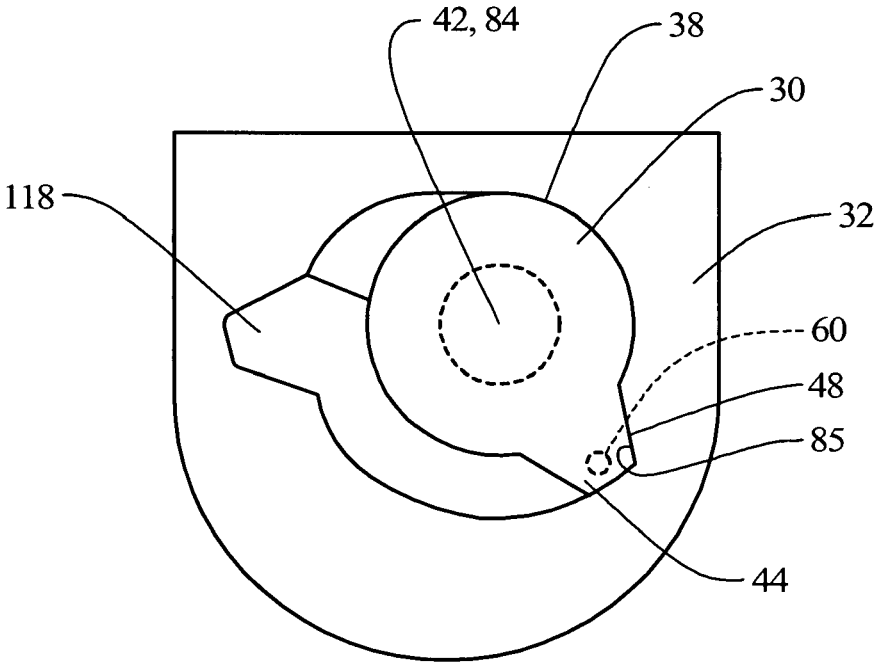
FIG. 10 is a plan view of the two door hinge members of FIG. 1 in a full open position of the door.

In the embodiment illustrated, in the full open position as shown in FIG. 10, the hemispherical projection 60 on the underside 58 of the cam portion 44 will engage in the hemispherical depression 104 in the hinge bearing 32 to provide a detent action, holding the door in the full open position and requiring an elevated amount of force to dislodge the detent mechanism to cause the door to begin movement to the closed position. The position of the projection 60 and the depression 104 may be reversed, with the projection on the support wall 67 and the depression on the underside 58 of the cam, and other known types of detent mechanisms may be provided to hold the door 16 in the full open position, or other intermediate open positions.

In the embodiment illustrated, the support wall 67 of the hinge bearing 32 and the support surface 40 of the hinge pin 30 are sloped in a helical manner such that as the refrigeration compartment door 16 is opened, the hinge pin will be moved upwardly on the sloped support wall, this lifting the door 16. While this will slightly increase the force necessary to open the door 16, it will ensure that the door will close completely when rotation of the door towards the closed position begins. As the closing motion occurs, gravity will assist in the rotation of the door 16 as the hinge pin 30 moves downwardly on the sloped support wall 67. This slope and the momentum the door 16 will have as it moves into the final closed position will cause the cam portion 44 to move into the recess 118, thus translating the door to the left towards the freezer compartment door 17, allowing the refrigeration door gasket 20 to slide into position adjacent to the freezer door gasket 22, without any interference between the two.

In embodiments where the support wall 67 and the support surface do not have a helical shape, but rather have a flat horizontal orientation, an additional mechanism, such as a spring acting between the hinge pin 30 and the hinge bearing 32, would be required to translate the door 16 to the left at the end of the rotational movement of the door, to seat the cam portion 44 in the recess 108.

Although only a single hinge arrangement has been shown and described, there would likely be at least two such hinge arrangements provided for each door, with one at a top and one at a bottom of the door. The configuration and arrangement for the hinge pin 30 and the hinge bearing 32 for the left door would be mirror images of the hinge pin and hinge bearing illustrated and described above.

Figure 11:
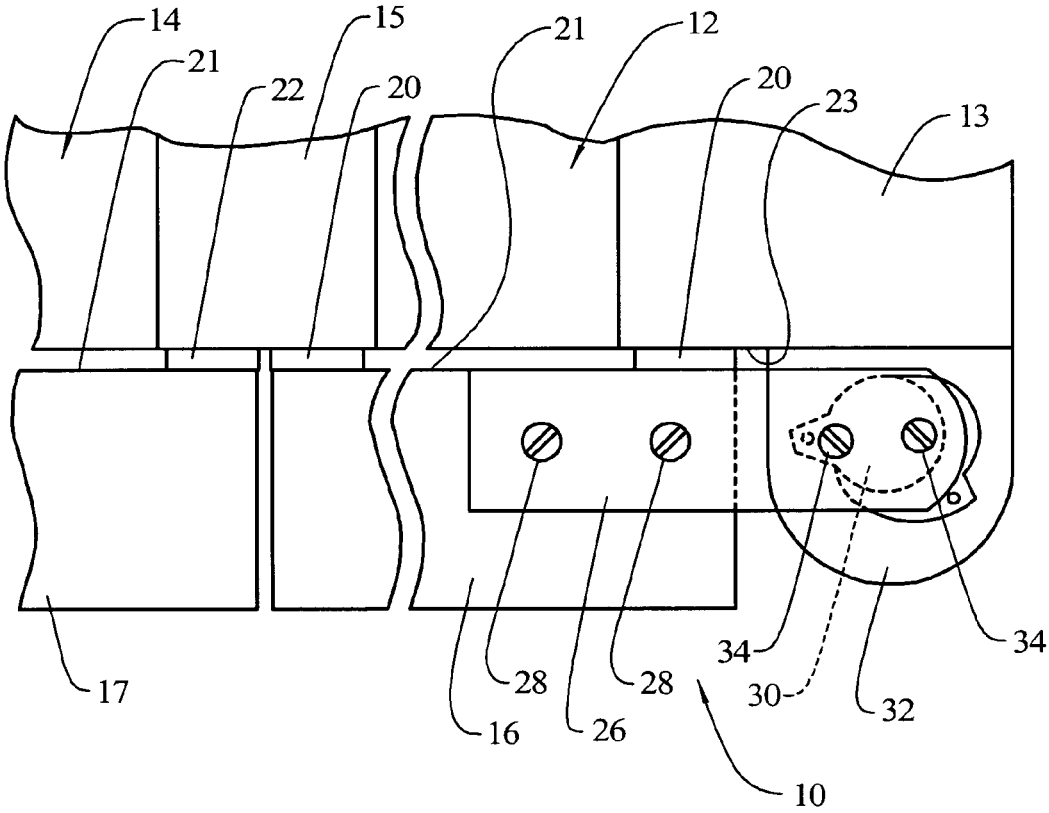
FIG. 11 is a partial plan view of the alternative embodiment of a refrigeration device and one hinge assembly.

The disclosed hinge arrangement 18 can also be used in a side-by-side refrigeration appliance construction as illustrated in FIG. 11. Essentially all of the same components are utilized, and the operation of the hinge and movement of the doors is identical to that described above. In a side-by-side refrigeration appliance, the dividing wall 15 typically does extend forward to end flush with the front face 23 of the refrigerator cabinet. However, the wall 15 might be narrow, and therefore the area for engagement by the side-by-side gasket portions of both a refrigerator compartment door 16 and a freezer compartment door 17 is limited. This may result in the two gaskets 20, 22 being positioned very close together which sometimes can cause rubbing interference when one door is opened relative to the other, and can cause an incomplete seal of one of the gaskets, particularly in view of variances due to manufacturing tolerances. Thus, the lateral translation of the doors away from one another prior to a pivoting movement will help to alleviate any problems associated with a rubbing engagement of the adjacent gaskets. The invention may also be used in other types of appliances, including cabinets, having doors that open and close towards one another. These other types of appliances may or may not have gaskets or other features. However, the hinge arrangement 18 may be suitable to provide an avoidance of rubbing between the doors as they open and close.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A door hinge arrangement for a door comprising:

a hinge bearing, a hinge pin adapted to be received in said hinge bearing and being rotatable in said hinge bearing about a vertical axis of said hinge pin, said hinge pin having a protruding cam portion extending perpendicular to said axis and a cylindrical rod portion extending along said axis, said hinge bearing having a recess formed in a side wall to receive a length of said cam portion when said hinge pin is in a first angular orientation relative to said hinge bearing corresponding to a closed position and having a slotted opening for receiving said cylindrical rod portion, said slotted opening being defined by a first semicircular end having a center in a first axial position and a radius substantially equal to a radius of said rod portion and a second semicircular end having a center in a second axial position and a radius substantially equal to said radius of said rod portion, a distance between said two axial positions corresponding to said received length of said cam portion, wherein, when said hinge pin is rotated relative to said hinge bearing to a second angular orientation, said cam acts against said recess to translate said axis of said pin from the first axial position to the second axial position, such that said hinge pin will first be translated substantially laterally before said hinge pin is further rotated about said second axial position.

2. A door hinge arrangement according to claim 1, wherein said hinge pin has an enlarged head portion at a top end of said cylindrical rod portion with a generally circular and vertical peripheral surface.

3. A door hinge arrangement according to claim 2, wherein said cam portion extends from said head portion.

4. A door hinge arrangement according to claim 2, wherein said hinge bearing has a pocket for receiving said enlarged head portion.

5. A door hinge arrangement according to claim 4, said pocket further having a substantially vertical side wall with at least a portion of said side wall having a cylindrical shape.

6. A door hinge arrangement according to claim 1, wherein said hinge pin has a generally helical lower surface.

7. A door hinge arrangement according to claim 6, said hinge bearing having a generally helical support surface for supporting said lower surface of said hinge pin.

8. A door hinge arrangement according to claim 1, wherein said hinge bearing has a pocket for receiving said hinge pin.

9. A door hinge arrangement according to claim 8, said pocket further having a recess.

10. A door hinge arrangement according to claim 1, including a detent mechanism arranged between said hinge pin and said hinge bearing whereby said hinge pin will be releasably retained in an open position of said hinge.

11. A door hinge arrangement according to claim 10, wherein said detent mechanism comprises a projection on said hinge pin and a mating depression in said hinge bearing which align when said hinge pin is rotated into a position in said hinge bearing representing a full open position of said hinge.

12. A door hinge arrangement for an appliance having a door comprising:

a hinge bearing affixed to said appliance adjacent an opening for said door, a hinge pin member affixed to be stationary relative to said door and adapted to be received in said hinge bearing, said hinge pin member having a cylindrical rod portion extending along an axis, said hinge pin member having an enlarged head portion at a top end of said cylindrical rod portion with a generally circular and vertical peripheral surface and a generally helical lower surface, said hinge pin member having a protruding cam portion extending perpendicular to said axis at said head portion, said hinge bearing having a pocket for receiving said enlarged head portion, said pocket having a generally helical support surface for supporting said lower surface of said head, said pocket further having a substantially vertical side wall with at least a portion of said side wall having a cylindrical shape, said pocket further having a recess formed in said side wall to receive a length of said cam portion when said hinge pin member is in a particular angular orientation relative to said hinge bearing corresponding to said door being in a closed position relative to said appliance, said hinge bearing having a slotted opening for receiving said cylindrical rod portion, said slotted opening being defined by a first semicircular end having a center in a first axial position and a radius substantially equal to a radius of said rod portion and a second semicircular end having a center in a second axial position and a radius substantially equal to said radius of said rod portion, a distance between said two axial positions corresponding to said received length of said cam portion, wherein, said hinge pin is received in said hinge bearing with said rod portion extending substantially vertically through said slotted opening, said enlarged head of said hinge pin is received in said pocket of said hinge bearing, said substantially helical surface of said head portion is supported on said substantially helical surface of said pocket, and in a first angular orientation of said hinge pin and door relative to said hinge pocket, said cam is received in said pocket, and when said hinge pin and door are rotated relative to said hinge bearing to a second angular orientation, said cam acts against side walls of said pocket to translate said axis of said pin from said first axial position to said second axial position, and said head rotates in said pocket, with said vertical surface of said pocket guiding said vertical cylindrical surface of said hinge pin, and said cylindrical rod portion of said hinge pin being rotationally guided by said slot, and said substantially helical surface of said head portion riding on said substantially helical surface of said pocket, such that said door and hinge pin will first be translated laterally as said door is rotated, and then rotated about said second axial position and said hinge pin and door will be elevated as said door is rotated to an open position.

13. A door hinge arrangement according to claim 12, including a detent mechanism arranged between said hinge pin and said hinge bearing whereby said hinge pin will be releasably retained in an open position of the door.

14. A door hinge arrangement according to claim 13, wherein said detent mechanism comprises a projection on said hinge pin and a mating depression in said hinge bearing which align when said hinge pin is rotated into a position in said hinge bearing representing a full open position of said door.

15. An appliance having a cabinet housing a first compartment adjacent to a second compartment, the two compartments being accessed through separate doors that pivotally open and pivotally close towards one another, comprising:

a hinge assembly provided near an outside top and bottom of each door, each of said hinge assemblies comprising:

a hinge bearing affixed to said appliance adjacent an opening for said door and comprising:

a pocket having an open top and bottom, with a perimeter defined by a side wall having a recess, and a support wall defining the open bottom, a hinge pin affixed to be stationary relative to said door, and comprising:

a generally helical lower surface that abuts the support wall when the hinge pin is received within the pocket, and a protruding cam portion sized to be received within the recess;

wherein when the door is in a closed position, the hinge pin is received within the pocket at a first axial position and the cam portion is received within the recess of the hinge bearing, and when the door is rotated from the closed position to an open position, the cam portion acts against said recess to translate the hinge pin substantially laterally from the first axial position to a second axial position before the hinge pin is further rotated about the second axial position.

16. An appliance according to claim 15, wherein said appliance is a refrigeration appliance with French style doors.

17. An appliance according to claim 15 wherein the support wall is sloped relative to the lower surface such that rotation of the door between the closed and open positions results in the raising of the door.

18. An appliance according to claim 17 wherein the support wall has a generally helical surface that abuts the lower surface.

19. An appliance according to claim 15 wherein the support wall defines a bearing surface for the lower surface.

* * * * *